US010209646B1

(12) United States Patent
Ota et al.

(10) Patent No.: US 10,209,646 B1
(45) Date of Patent: Feb. 19, 2019

(54) IMAGE FORMING APPARATUS

(71) Applicant: KONICA MINOLTA, INC., Chiyoda-ku, Tokyo (JP)

(72) Inventors: Kazuyoshi Ota, Chiryu (JP); Hiroaki Umemoto, Neyagawa (JP); Futoshi Okazaki, Toyokawa (JP); Hidetoshi Noguchi, Tahara (JP); Masanori Kawada, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/032,220

(22) Filed: Jul. 11, 2018

(30) Foreign Application Priority Data

Aug. 8, 2017 (JP) ..... 2017-153100

(51) Int. Cl.
*G03G 15/09* (2006.01)
*G03G 15/02* (2006.01)
*G03G 15/16* (2006.01)
*G03G 15/00* (2006.01)

(52) U.S. Cl.
CPC ..... *G03G 15/0907* (2013.01); *G03G 15/0225* (2013.01); *G03G 15/1615* (2013.01); *G03G 15/602* (2013.01)

(58) Field of Classification Search
USPC ..... 399/38, 46, 49, 66, 265, 267, 270, 297, 399/302, 308, 310
See application file for complete search history.

(56) References Cited

U.S. PATENT DOCUMENTS 6,564,021 B1 * 5/2003 Nakai ..... G03G 15/0131 399/49
9,256,168 B2 * 2/2016 Tanaka ..... G03G 15/1675
9,372,462 B1 * 6/2016 Ohta ..... G03G 15/50
9,665,043 B2 * 5/2017 Funatani ..... G03G 15/161

FOREIGN PATENT DOCUMENTS

JP 2013-105145 A 5/2013

* cited by examiner

*Primary Examiner* — Hoan Tran
(74) *Attorney, Agent, or Firm* — Buchanan Ingersoll & Rooney PC

(57) ABSTRACT

An image forming apparatus includes: an image carrier that rotates while carrying a toner image; an image former that forms the toner image; a transfer roller that transfers the toner image to a recording medium; and a bias voltage applier that applies a voltage to the transfer roller, wherein the image former forms transfer images and forms a patch image with toner between a first transfer image and a second transfer image, and the bias voltage applier applies a first voltage having a polarity opposite to a charge polarity of the toner to the transfer roller, applies a second voltage having the polarity opposite to the charge polarity of the toner and larger than the first voltage to the transfer roller, and applies a third voltage having the polarity opposite to the charge polarity of the toner and smaller than the second voltage to the transfer roller.

9 Claims, 11 Drawing Sheets

IMAGE FORMING APPARATUS

The entire disclosure of Japanese patent Application No. 2017-153100, filed on Aug. 8, 2017, is incorporated herein by reference in its entirety.

BACKGROUND

Technological Field

The present disclosure relates to an image forming apparatus, and more particularly, to a transfer apparatus of an image forming apparatus.

Description of the Related Art

When a patch image is formed on a transfer belt in an image forming apparatus using a secondary transfer roller of a type in which the secondary transfer roller is always in pressure contact with the transfer belt, the patch image and the secondary transfer roller come into contact with each other at a secondary transfer position, and toner of the patch image adheres to the secondary transfer roller. When the toner adheres to the secondary transfer roller, it is not preferable because the toner makes the back side dirty of a recording medium such as a sheet in the next printing.

Therefore, conventionally, in order to prevent adhesion of the toner to the recording medium, a technique has been developed for removing the toner adhering to the secondary transfer roller by applying a bias voltage to the secondary transfer roller. For example, JP 2013-105145 A discloses a technique of "repeatedly applying a secondary transfer bias voltage to a secondary transfer member while alternating polarity" (see [SOLUTION] of [ABSTRACT]).

However, in the above-described conventional technique, since most of the toner adhering to the secondary transfer roller is weakly charged toner, an amount of toner that can be removed by one application is small and it is necessary to repeatedly apply the bias voltage. For that reason, after the formation of the patch image, it is necessary to rotate the secondary transfer roller for a long time for cleaning the secondary transfer roller, and abrasion of the secondary transfer roller and a decrease in productivity have been caused. Therefore, a technique is required for reducing time for cleaning the secondary transfer roller.

SUMMARY

The present disclosure has been made to solve the above-described problems, and an object of an aspect is to reduce the time for cleaning the secondary transfer roller.

To achieve the abovementioned object, according to an aspect of the present invention, an image forming apparatus reflecting one aspect of the present invention comprises: an image carrier that rotates while carrying a toner image; an image former that forms the toner image on the image carrier; a transfer roller that is provided to face the image carrier and transfers the toner image to a recording medium conveyed to a contact region by being brought into contact with the image carrier while rotating; and a bias voltage applier that applies a voltage to the transfer roller, wherein the image former forms, on the image carrier with toner, a plurality of transfer images to be transferred onto the recording medium, and forms a patch image with toner between a first transfer image formed on the image carrier and a second transfer image formed thereafter, and the bias voltage applier applies a first voltage having a polarity opposite to a charge polarity of the toner to the transfer roller while each of the transfer images is transferred to the recording medium, applies a second voltage having the polarity opposite to the charge polarity of the toner and larger than the first voltage to the transfer roller while a contact portion on the transfer roller in contact with the patch image is in contact with the image carrier again by rotation of the transfer roller, and applies a third voltage having the polarity opposite to the charge polarity of the toner and smaller than the second voltage to the transfer roller, after application of the second voltage, until transfer of the second transfer image starts.

BRIEF DESCRIPTION OF THE DRAWINGS

The objects, advantages, aspects, and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
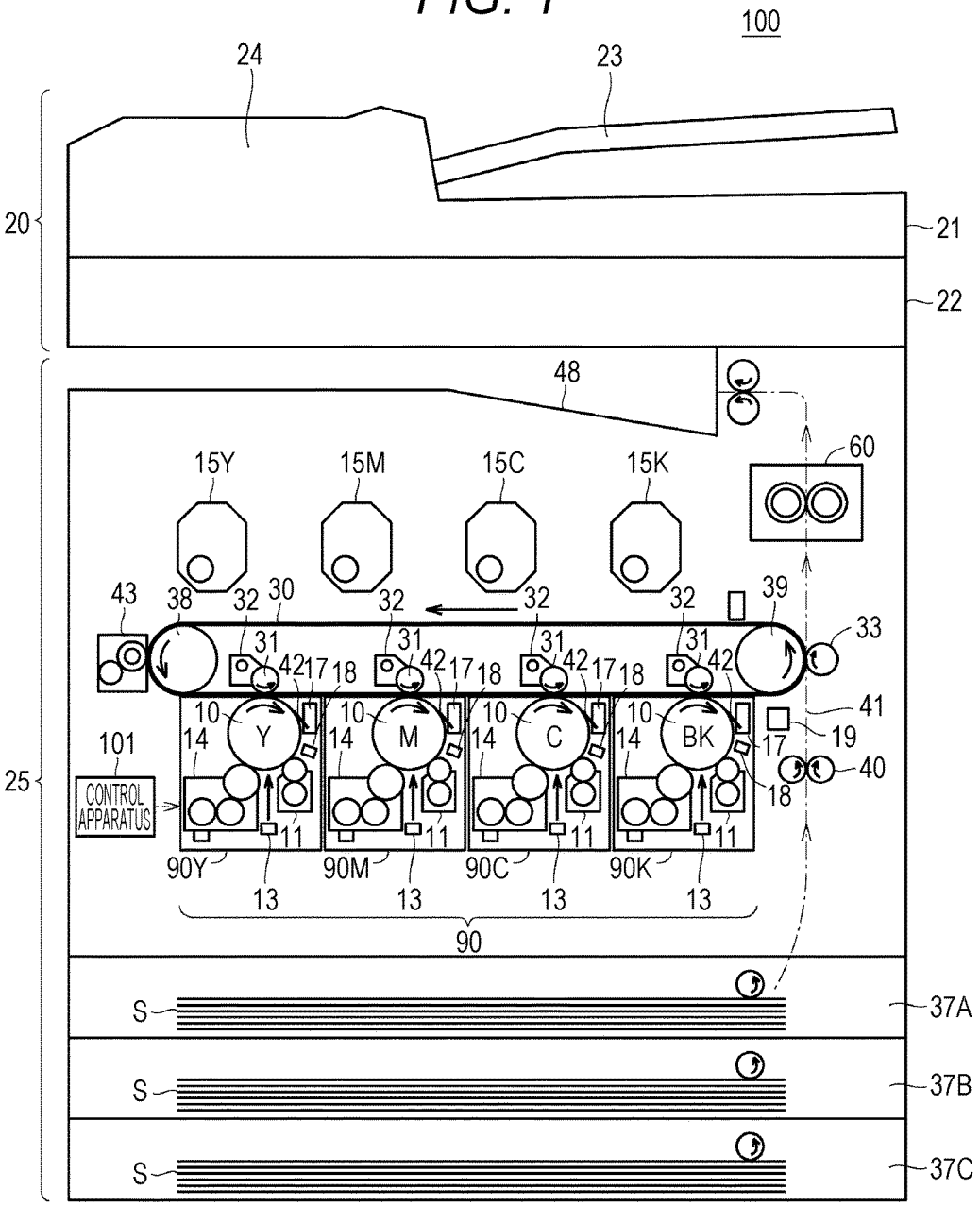
FIG. 1 is a diagram showing an example of an overall structure of an image forming apparatus.

Hereinafter, one or more embodiments of the present invention will be described with reference to the drawings. However, the scope of the invention is not limited to the disclosed embodiments. In the following description, the same components and constituents are denoted by the same reference numerals. The names and functions thereof are also the same. Therefore, detailed description thereof will not be repeated. Note that, embodiments and modifications described below may be selectively combined as appropriate.

First Embodiment

[1. Configuration of Image Forming Apparatus 100]

With reference to FIG. 1, an image forming apparatus 100 will be described. FIG. 1 is a diagram showing an example of an overall structure of the image forming apparatus 100.

FIG. 1 shows the image forming apparatus 100 as a color printer. Hereinafter, the image forming apparatus 100 as a color printer will be described, but the image forming apparatus 100 is not limited to a color printer. For example, the image forming apparatus 100 may be a monochrome printer, or may be a multifunction machine (so-called multi functional peripheral (MFP)) of a monochrome printer, a color printer, and a facsimile.

The image forming apparatus 100 includes a scanner 20 as an image reading device and a printer 25 including an image former 90 (specifically, image formers 90Y, 90M, 90C, and 90K). The scanner 20 includes a cover 21, a sheet table 22, a tray 23, and an auto document feeder (ADF) 24. One end of the cover 21 is fixed to the sheet table 22, and the cover 21 can be opened and closed with the one end as a fulcrum.

A user of the image forming apparatus 100 can set a document on the sheet table 22 by opening the cover 21. When accepting a scan instruction in a state where the document is set on the sheet table 22, the image forming apparatus 100 starts scanning of the document set on the sheet table 22. In addition, in the image forming apparatus 100, when a scan instruction is accepted in a state where documents are set on the tray 23, the documents are automatically read one by one by the ADF 24.

The printer 25 includes the image formers 90Y, 90M, 90C, and 90K, an IDC sensor 19, a transfer belt 30, a primary transfer roller 31, a transfer drive machine 32, a secondary transfer roller 33, cassettes 37A to 37C, a driven roller 38, a drive roller 39, a timing roller 40, a cleaning unit 43, a fixing device 60, and a control apparatus 101.

The image formers 90Y, 90M, 90C, and 90K are arranged in order along the transfer belt 30. The image former 90Y receives a toner supply from a toner bottle 15Y to form a yellow (Y) toner image. The image former 90M receives a toner supply from a toner bottle 15M to form a magenta (M) toner image. The image former 90C receives a toner supply from a toner bottle 15C to form a cyan (C) toner image. The image former 90K receives a toner supply from a toner bottle 15K to form a black (BK) toner image.

The image formers 90Y, 90M, 90C, and 90K are arranged in order of a rotation direction of the transfer belt 30 along the transfer belt 30. The image formers 90Y, 90M, 90C, and 90K each include a photosensitive member 10 configured to be rotatable, a charging apparatus 11, an exposure apparatus 13, a developing device 14, a cleaning unit 17, and a toner sensor 18.

After the image formers 90Y, 90M, 90C, and 90K operate as described above, by transferring by the transfer drive machine 32, the yellow (Y) toner image, magenta (M) toner image, cyan (C) toner image, and black (BK) toner image are sequentially superimposed and transferred from the photosensitive member 10 to the transfer belt 30. Thus, a color toner image is formed on the transfer belt 30.

The IDC sensor 19 detects density of a toner image 35 formed on the transfer belt 30. Typically, the IDC sensor 19 is a light intensity sensor including a reflection type photosensor, and detects intensity of reflected light from the surface of the transfer belt 30.

The transfer belt 30 is stretched around the driven roller 38 and the drive roller 39. The drive roller 39 is connected to a motor (not shown). The control apparatus 101 controls the motor, whereby the drive roller 39 is rotated. The transfer belt 30 and the driven roller 38 are rotated in conjunction with the drive roller 39. Thus, the toner image 35 on the transfer belt 30 is sent to the secondary transfer roller 33.

Sheets of different sizes are set in the respective cassettes 37A to 37C. The sheets each are an example of the recording medium. The sheets are fed from any of the cassettes 37A to 37C one by one to the secondary transfer roller 33 by the timing roller 40 along the conveying path 41.

The control apparatus 101 controls a transfer voltage to be applied to the secondary transfer roller 33 in accordance with timing at which a sheet is fed out. The secondary transfer roller 33 applies a transfer voltage having a polarity opposite to a charge polarity of the toner image 35 to the sheet being conveyed. As a result, the toner image 35 is attracted to the secondary transfer roller 33 from the transfer belt 30, and the toner image 35 on the transfer belt 30 is transferred. Details of the application of the transfer voltage to the secondary transfer roller 33 will be described later.

Conveying timing of the sheet to the secondary transfer roller 33 is controlled by the timing roller 40 in accordance with a position of the toner image 35 on the transfer belt 30. As a result, the toner image 35 on the transfer belt 30 is transferred to an appropriate position on the sheet.

The fixing device 60 pressurizes and heats the sheet passing through the fixing device 60. Thus, the toner image is fixed on the sheet. Thereafter, the sheet is ejected to a tray 49.

The cleaning unit 43 collects toner remaining on the surface of the transfer belt 30 after the transfer of the toner image from the transfer belt 30 to the sheet. The collected toner is conveyed by a conveying screw (not shown) and stored in a waste toner container (not shown). Details of the cleaning unit 43 will be described later.

[2. Hardware Configuration]

Figure 2:
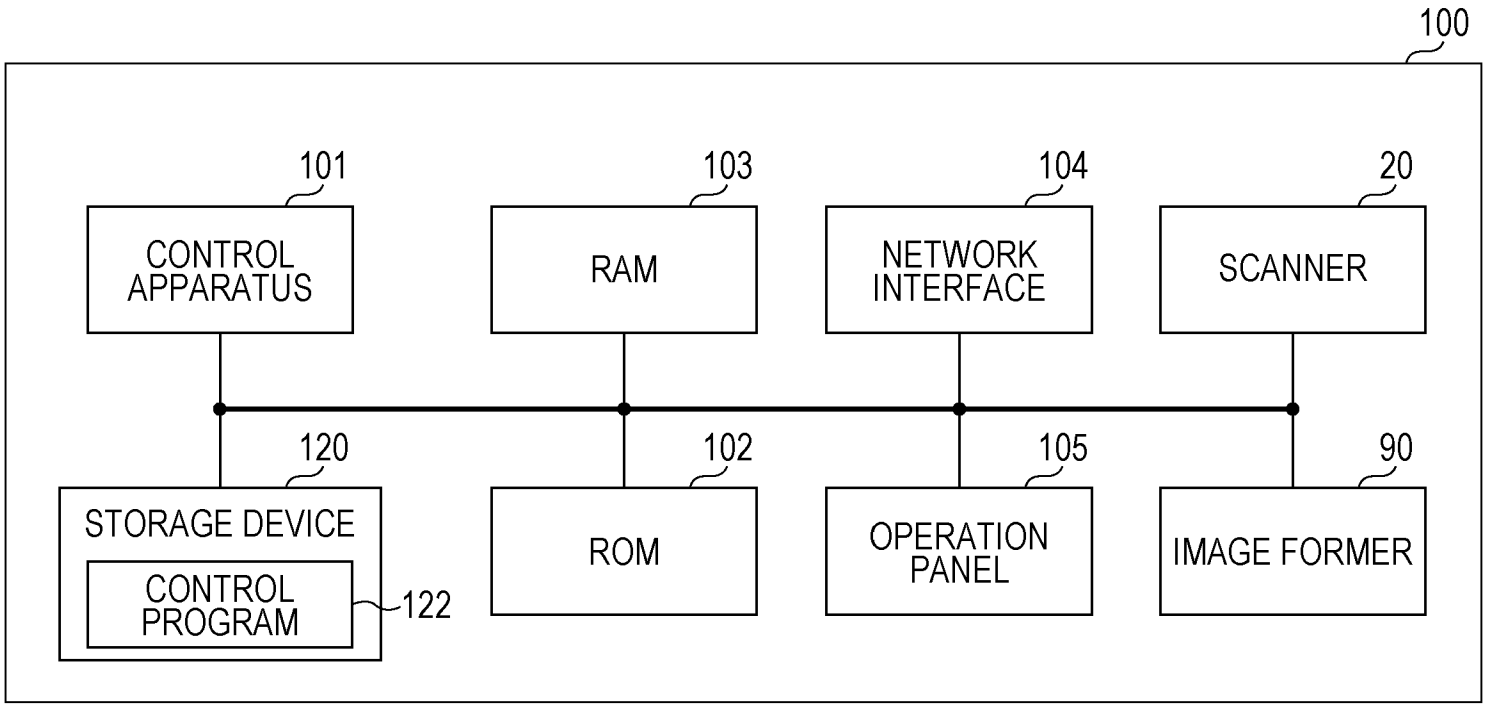
FIG. 2 is a block diagram showing a main hardware configuration of the image forming apparatus.

With reference to FIG. 2, an example will be described of a hardware configuration of the image forming apparatus 100. FIG. 2 is a block diagram showing a main hardware configuration of the image forming apparatus 100.

As shown in FIG. 2, the image forming apparatus 100 includes the control apparatus 101, read only memory (ROM) 102, random access memory (RAM) 103, a network interface 104, an operation panel 105, the scanner 20, the image former 90, and a storage apparatus 120.

The control apparatus 101 includes, for example, at least one integrated circuit. The integrated circuit includes, for example, at least one central processing unit (CPU), at least one application specific integrated circuit (ASIC), at least one field programmable gate array (FPGA), a combination thereof, or the like.

The control apparatus 101 controls operation of the image forming apparatus 100 by executing various programs such as a program 122 for adjusting a control parameter of the image forming apparatus 100. The control apparatus 101 reads the program 122 from the storage apparatus 120 to the RAM 103 on the basis of acceptance of an execution command of the program 122. The RAM 103 functions as a working memory and temporarily stores various data necessary for executing the program 122.

An antenna (not shown) and the like are connected to the network interface 104. The image forming apparatus 100 exchanges data with external communication devices via the antenna. The external communication devices include, for example, a mobile communication terminal such as a smartphone, a server, and the like. The image forming apparatus 100 may be configured so that the program 122 can be downloaded from the server via the antenna.

The operation panel 105 includes a display (not shown) and a touch panel (not shown). The display and the touch panel are overlapped with each other and accept operation on the image forming apparatus 100 by touch operation. As an example, the operation panel 105 receives operation for executing control parameter adjustment processing and the like.

The storage apparatus 120 is, for example, a hard disk, a solid state drive (SSD), or another storage apparatus. The storage apparatus 120 may be either a built-in type or an external type. The storage apparatus 120 stores the program 122 and the like according to the present embodiment. However, a storage location of the program 122 is not limited to the storage apparatus 120, and the program 122 may be stored in a storage area of the control apparatus 101 (for example, a cache), the ROM 102, the RAM 103, an external device (for example, a server), or the like.

The program 122 may be provided as a part of an arbitrary program, not as a single program. In this case, control processing according to the present embodiment is implemented in cooperation with the arbitrary program. Even programs not including some of such modules do not depart from the gist of the program 122 according to the present embodiment.

Further, some or all of the functions provided by the program 122 may be implemented by dedicated hardware. Further, the image forming apparatus 100 may be configured in a form like a so-called cloud service in which at least one server executes a part of the processing of the program 122.

[Bias Voltage Control Device 121]

Figure 3A:
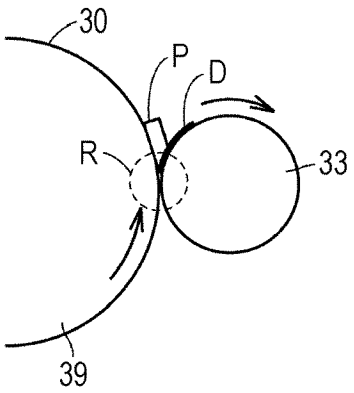
FIGS. 3A to 3C are diagrams schematically showing bias voltage control.
Figure 3B:
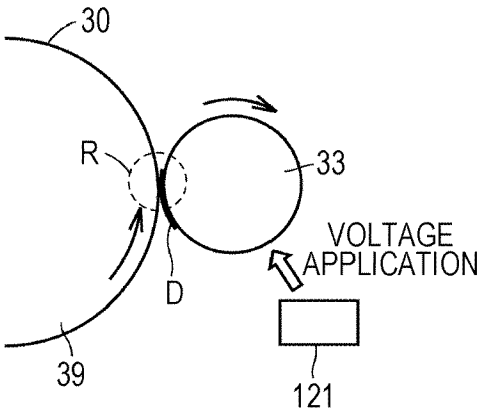
Figure 3C:
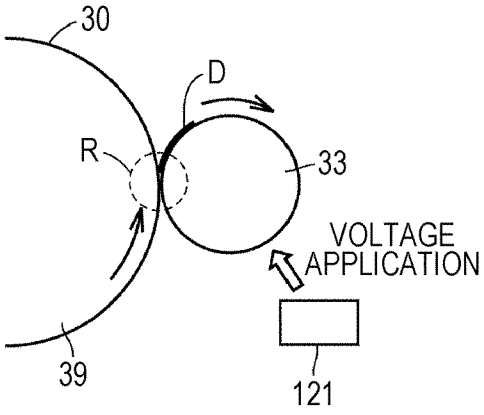
Figure 4:
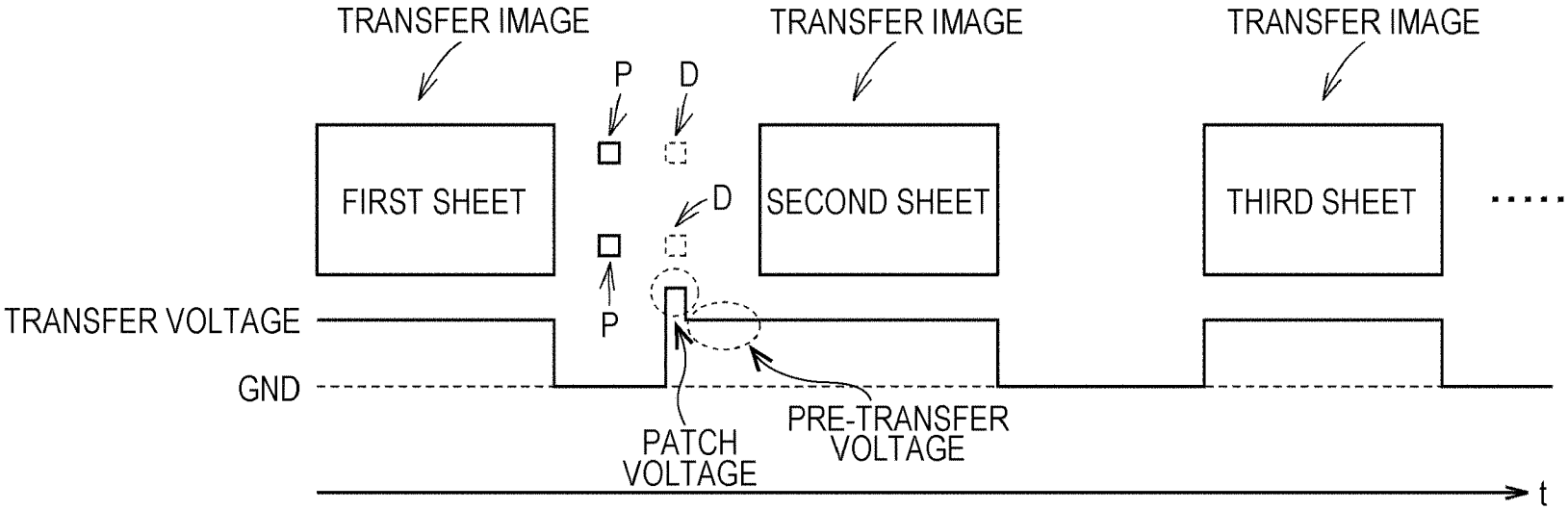
FIG. 4 is a timing chart in a bias voltage control device.

With reference to FIGS. 3A to 3C and FIG. 4, bias voltage control will be described in a bias voltage control device 121 according to the present embodiment. FIGS. 3A to 3C are diagrams schematically showing the bias voltage control. FIG. 4 is a timing chart in the bias voltage control device 121.

The image former 90 forms, on the transfer belt 30, a transfer image to be transferred onto a sheet. Then, the image former 90 forms a patch image between a transfer image and a subsequent transfer image. The patch image is an image to be formed on the transfer belt 30 in order to discharge old toner in developing powder, or in order to be used as a density reading pattern for density adjustment during image stabilization, and is an image not to be transferred to the sheet. In a case where the patch image is prepared for density adjustment, the density adjustment by the patch image is necessary every predetermined number of printed sheets (for example, 50 sheets). From the viewpoint of not lowering the productivity of the image former 90, it is very important to shorten time for removing the prepared patch image from the secondary transfer roller 33.

The bias voltage control device 121 implemented by the control apparatus 101 applies, onto the transfer belt 30, a transfer voltage (for example, +1 kV to +2 kV) having the polarity opposite to the charge polarity of the toner while the transfer image is transferred onto the sheet, in a region where the secondary transfer roller 33 and the transfer belt 30 are in contact with each other (hereinafter referred to as a contact region R). As shown in FIG. 3A, after a patch image P formed subsequently to the transfer image comes into contact with the secondary transfer roller 33, while a contact portion D on the secondary transfer roller 33 in contact with the patch image P is in contact with the transfer belt 30 again by rotation of the secondary transfer roller 33 (period shown in FIGS. 3B to 3C), the bias voltage control device 121 applies, to the transfer roller, a patch voltage (for example, +2 kV to +3 kV) having the polarity opposite to the charge polarity of the toner and larger than the transfer voltage.

FIG. 4 shows timing at which the transfer image, the patch image P and the contact portion D pass through the contact region R, and the magnitude of an applied voltage at that time. As shown in FIG. 4, the bias voltage control device 121 applies, to the transfer roller, a pre-transfer voltage (for example, +1 kV to +2 kV) having the polarity opposite to the charge polarity of the toner and smaller than the patch voltage, after the application of the patch voltage, until the transfer of the subsequent transfer image starts. Here, for example, the magnitude of the pre-transfer voltage and the magnitude of the transfer voltage can be made equal to each other.

As described above, the bias voltage control device 121 controls the applied voltage, whereby discharge occurs from weakly charged toner adhering to the contact portion D in contact with the patch image P on the secondary transfer roller 33, and the weakly charged toner is charged to the same polarity as the charge polarity of the toner. Thereafter, even if the transfer voltage having the polarity opposite to the charge polarity of the toner is continuously applied to the secondary transfer roller 33 until the subsequent transfer image finishes passing through the contact region R, it is possible to continue to cause the toner to adhere to the secondary transfer roller 33, so that an amount of toner adhering to the back side of the subsequent sheet is reduced, and it can be suppressed that the back side becomes dirty.

[Processing Procedure]

Figure 5:
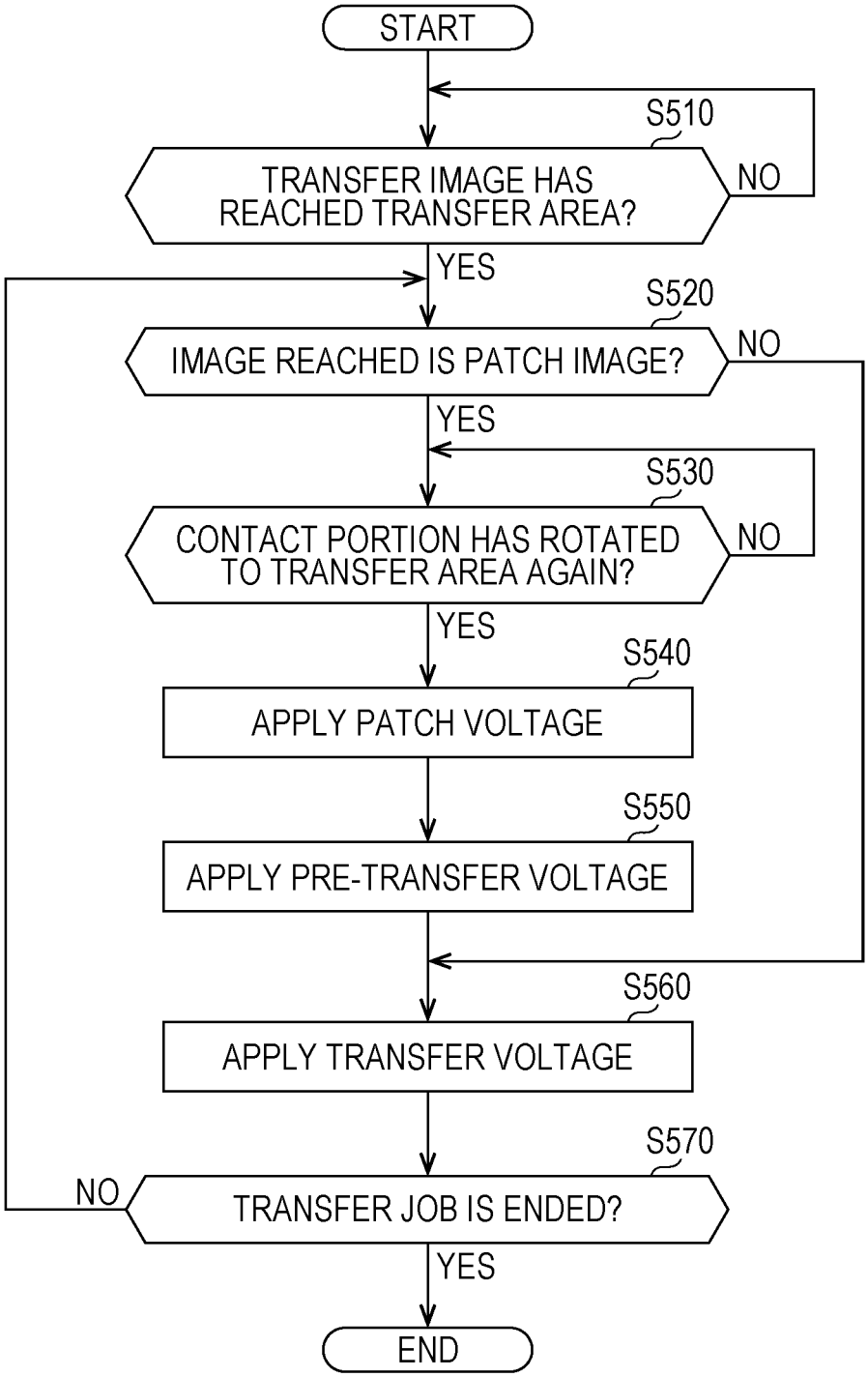
FIG. 5 is a flowchart showing a procedure of voltage application processing.

With reference to FIG. 5, a procedure will be described of voltage application processing according to a first embodiment. FIG. 5 is a flowchart showing the procedure of the voltage application processing. The processing is implemented, for example, by the CPU of the control apparatus 101 executing a given program.

In step S510, the control apparatus 101 determines whether or not a transfer image has reached a transfer area on the basis of timing at which the image former 90 formed the transfer image and rotational speed of the transfer belt 30. In a case where it is determined that the transfer image has reached the transfer area (YES in step S510), the control apparatus 101 switches control to step S520. Otherwise (NO in step S510), the control apparatus 101 repeats step S510.

In step S520, the control apparatus 101 determines whether or not the image having reached the transfer area is a patch image on the basis of timing at which the image former 90 formed the patch image and the rotational speed of the transfer belt 30. In a case where it is determined that the image having reached the transfer area is the patch image (YES in step S520), the control apparatus 101 switches the control to step S530. Otherwise (NO in step S520), the control apparatus 101 switches the control to step S550.

In step S530, on the basis of rotational speed of the secondary transfer roller 33, the control apparatus 101 determines whether or not a contact portion of the secondary transfer roller 33 in contact with the patch image has rotated to the transfer area again. In a case where it is determined that the contact portion of the secondary transfer roller 33 has rotated to the transfer area again (YES in step S530), the control apparatus 101 switches the control to step S540.

In step S540, the control apparatus 101 applies a patch image voltage to the secondary transfer roller 33 while the contact portion of the secondary transfer roller 33 passes through the transfer area. The control apparatus 101 switches the control to step S550.

In step S550, the control apparatus 101 applies a transfer voltage having the polarity opposite to the charge polarity of the toner to the secondary transfer roller 33. The control apparatus 101 switches the control to step S560.

In step S560, the control apparatus 101 determines whether or not to end a transfer job on the basis of an instruction accepted from the operation panel 105. In a case where it is determined to end the transfer job (YES in step S560), the control apparatus 101 ends the processing. Otherwise (NO in step S560), the control apparatus 101 switches the control to step S510 again and repeats the above-described processing.

As described above, according to the present embodiment, while the contact portion on the secondary transfer roller 33 in contact with the patch image is in contact with the transfer belt 30 again by the rotation of the secondary transfer roller 33, the control apparatus 101 applies, to the transfer roller, the patch voltage having the polarity opposite to the charge polarity of the toner and larger than the transfer voltage. The control apparatus 101 further applies, to the transfer roller, the pre-transfer voltage having the polarity opposite to the charge polarity of the toner and smaller than the patch image voltage, after applying the patch voltage to the secondary transfer roller 33, until the subsequent transfer image reaches the transfer area.

With the above configuration, discharge occurs from the weakly charged toner in the area corresponding to the patch on the secondary transfer roller 33, and the weakly charged toner is charged to the same polarity as the charge polarity of the toner. Thereafter, even if the application of the voltage having the polarity opposite to the charge polarity of the toner to the secondary transfer roller 33 continues until the subsequent transfer image finishes passing through the transfer area, it is possible to continue to cause the toner to electrically adhere to the secondary transfer roller 33. As a result, it is possible to reduce time for cleaning the secondary transfer roller 33. Further, by reducing rotation time of the secondary transfer roller 33, not only the secondary transfer roller 33 but also other units can have a longer service life.

Second Embodiment

[Overview]

A second embodiment is different from the first embodiment in that a bias voltage control device 221 applies a patch image voltage to the secondary transfer roller 33 immediately after the patch image P has passed through the contact region R. Note that, the image forming apparatus according to the present embodiment is implemented by the same configuration as that of the image forming apparatus 100 according to the above-described embodiment. Therefore, the description of the configuration thereof will not be repeated.

[Details]

Figure 6A:
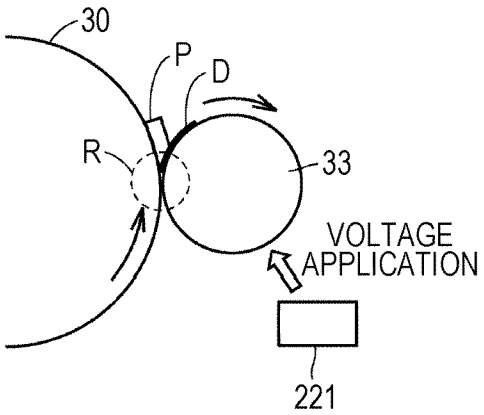
FIGS. 6A to 6C are diagrams schematically showing bias voltage control according to a second embodiment.
Figure 6B:
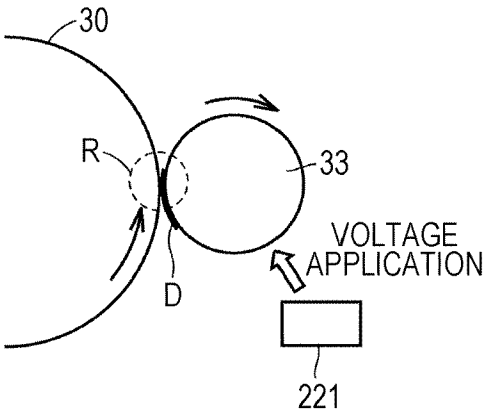
Figure 6C:
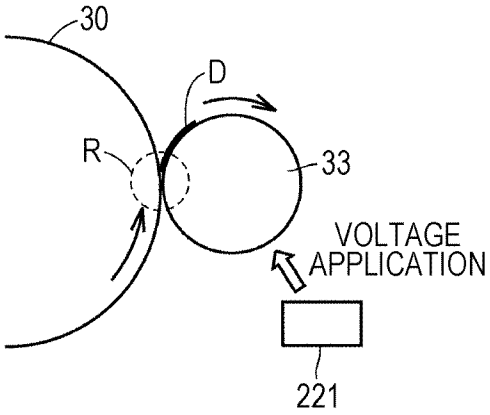
Figure 7:
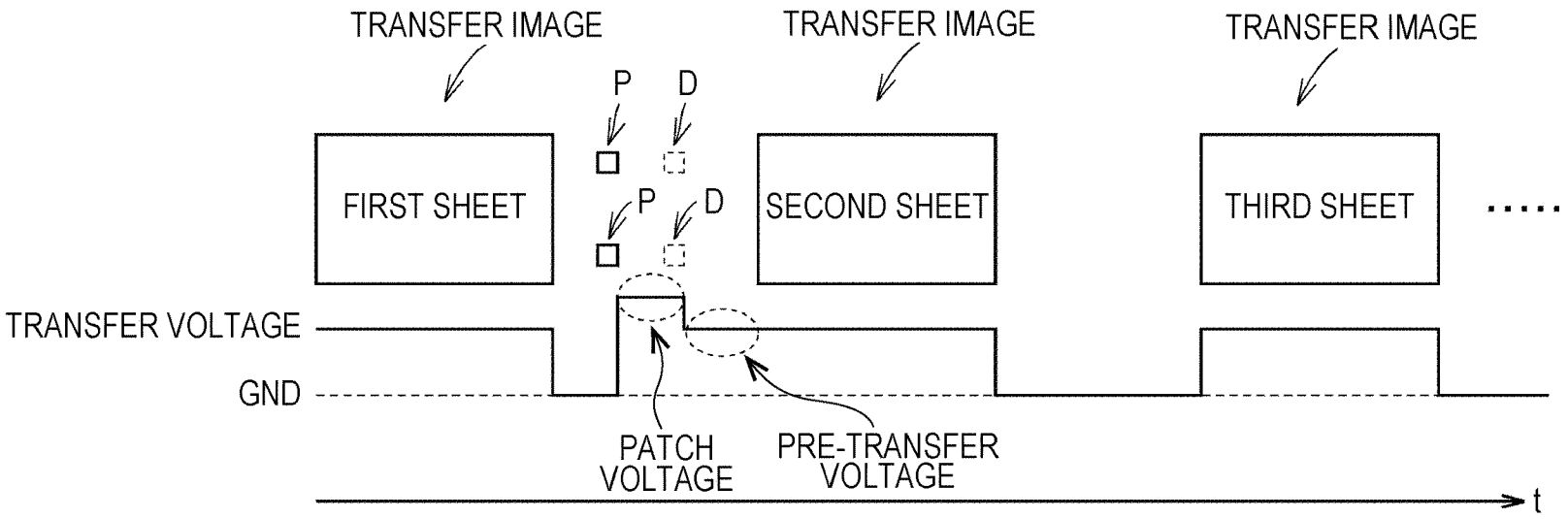
FIG. 7 is a timing chart of bias voltage application by a bias voltage control device according to the second embodiment.

With reference to FIGS. 6A to 6C and FIG. 7, bias voltage control will be described in the bias voltage control device 221 according to the present embodiment. FIGS. 6A to 6C are diagrams schematically showing the bias voltage control according to the second embodiment. FIG. 7 is a timing chart of bias voltage application by the bias voltage control device 221 according to the second embodiment.

As shown in FIG. 6A, the bias voltage control device 221 applies the patch image voltage to the secondary transfer roller 33 immediately after the patch image P has passed through the contact region R. As shown in FIGS. 6B and 6C, as the secondary transfer roller 33 rotates, until the contact portion D with the patch image P on the secondary transfer roller 33 passes through the contact region R, the bias voltage control device 221 continues to apply the patch image voltage to the secondary transfer roller 33.

As shown in FIG. 7, the bias voltage control device 221 applies a patch image voltage larger than a transfer voltage to the secondary transfer roller 33, immediately after the patch image P has passed through the contact region R, until the contact portion D with the patch image P on the secondary transfer roller 33 passes through the contact region R. Since application of a pre-transfer voltage and application of the transfer voltage thereafter are the same as those of the first embodiment, description thereof will not be repeated.

As described above, according to the present embodiment, the bias voltage control device 221 applies the patch image voltage to the secondary transfer roller 33 immediately after the patch image P has passed through the contact region. With such a configuration, it becomes unnecessary to apply the voltage until the entire contact portion D on the secondary transfer roller 33 finishes passing through the contact region R again, and voltage application time can be shortened.

Third Embodiment

[Overview]

A third embodiment is different from the first embodiment in that a bias voltage control device 321 further applies, to the secondary transfer roller 33, a voltage (for example, +2 kV to +3 kV) having the polarity opposite to the charge polarity of the toner and larger than the transfer voltage, after the transfer of the transfer image subsequent to the patch image. Note that, the image forming apparatus according to the present embodiment is implemented by the same configuration as that of the image forming apparatus 100 according to the above-described embodiment. Therefore, the description of the configuration thereof will not be repeated.

[Details]

Figure 8:
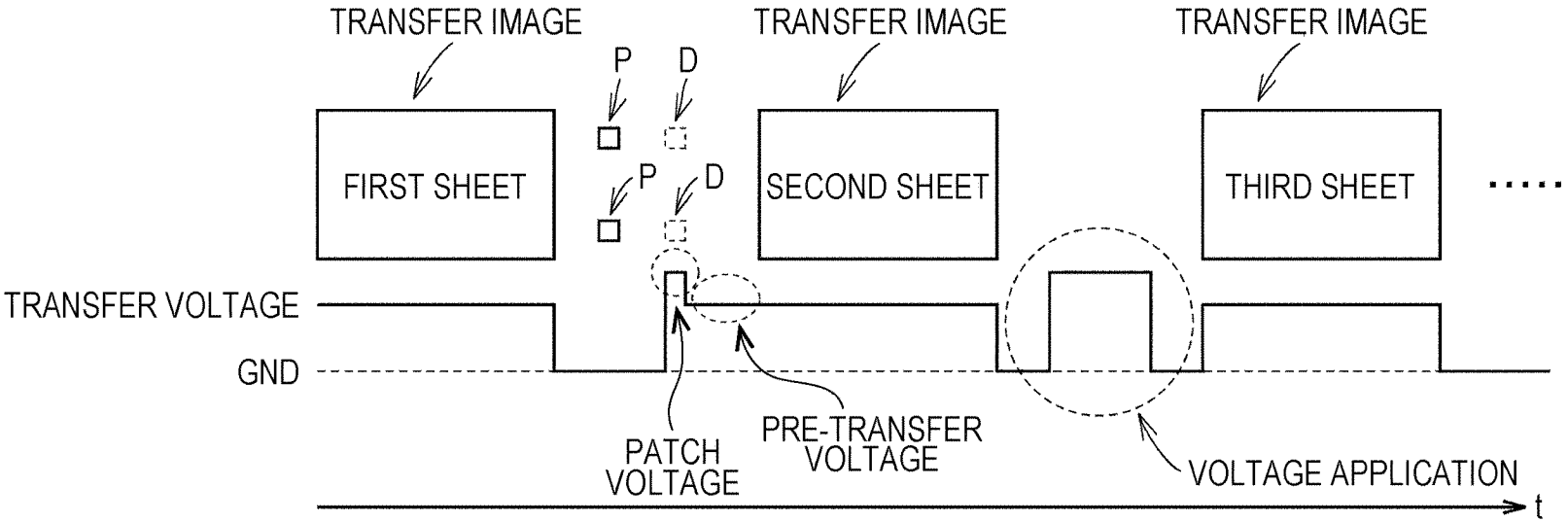
FIG. 8 is a timing chart of bias voltage application by a bias voltage control device according to a third embodiment.

With reference to FIG. 8, bias voltage control will be described in the bias voltage control device 321 according to the present embodiment. FIG. 8 is a timing chart of bias voltage application by the bias voltage control device 321 according to the third embodiment.

As shown in FIG. 8, the bias voltage control device 321 applies a voltage higher than the transfer bias to the secondary transfer roller 33 after the transfer image subsequent to the patch image is transferred. In this way, it is possible to reliably charge the weakly charged toner that has not been charged to the same polarity as the charge polarity of the toner at the time of applying the patch voltage, to the same polarity as the charge polarity of the toner, and it is possible to increase the toner charged to the same polarity as the charge polarity. As a result, an amount of toner adhering to the back side of the sheet to which the subsequent transfer image is transferred is reduced, so that it is possible to prevent the back side of the sheet from becoming dirty.

Fourth Embodiment

[Overview]

A fourth embodiment is different from the first embodiment in that a bias voltage control device 421 further applies a voltage having the same polarity as the charge polarity of the toner to the secondary transfer roller 33 after the formation of the transfer image subsequent to the patch image. Note that, the image forming apparatus according to the present embodiment is implemented by the same configuration as that of the image forming apparatus 100 according to the above-described embodiment. Therefore, the description of the configuration thereof will not be repeated.

[Details]

Figure 9:
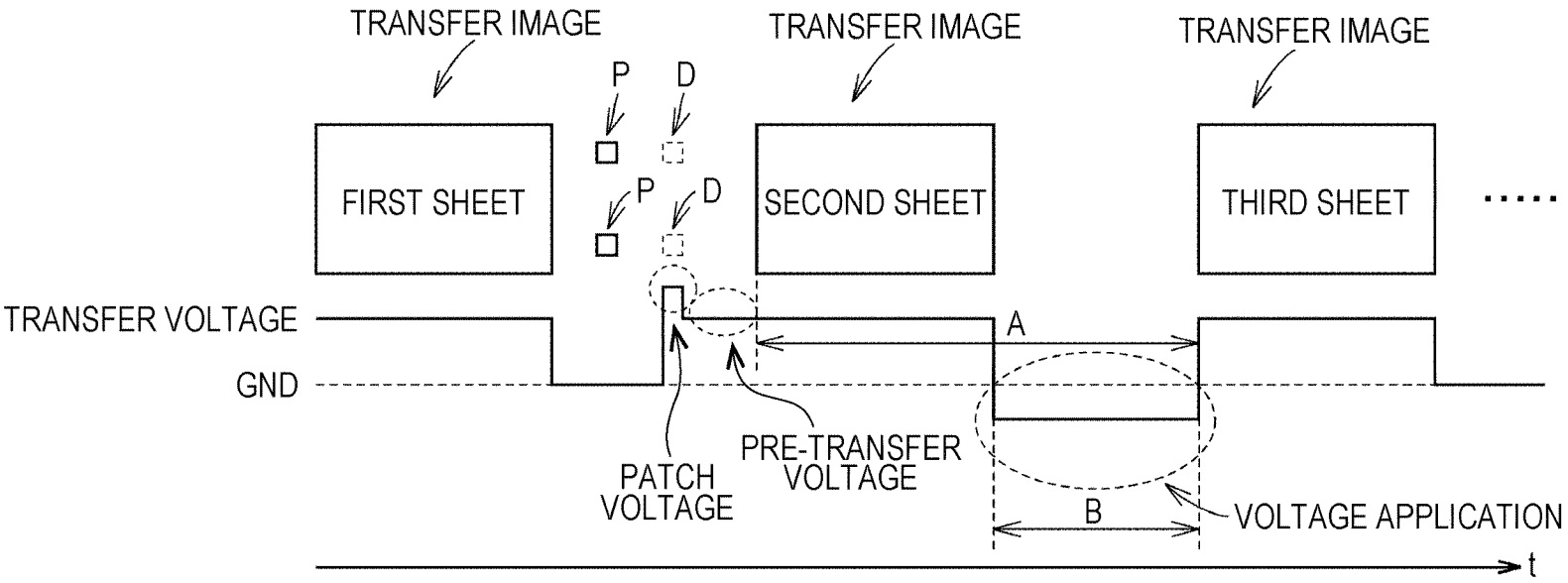
FIG. 9 is a timing chart of bias voltage application by a bias voltage control device according to a fourth embodiment.

With reference to FIG. 9 and FIGS. 10A to 10D, bias voltage control will be described in the bias voltage control device 421 according to the present embodiment. FIG. 9 is a timing chart of bias voltage application by the bias voltage control device 421 according to the fourth embodiment. FIGS. 10A to 10D are diagrams showing a relationship between the bias voltage application and an interval between formed images according to the fourth embodiment.

As shown in FIG. 9, the bias voltage control device 421 applies the voltage (for example, −500 V to −1 kV) having the same polarity as the charge polarity of the toner to the secondary transfer roller 33 after the formation of the transfer image subsequent to the patch image. In this way, the toner adhering to the secondary transfer roller 33 is moved from the secondary transfer roller 33 onto the transfer belt 30 by electrostatic repulsive force, so that accumulation of the toner on the secondary transfer roller 33 can be suppressed. In addition, by performing voltage application after the transfer of the transfer image, the toner does not move to the back side of the sheet, so that it is possible to prevent the back side of the sheet from becoming dirty.

Figure 10A:
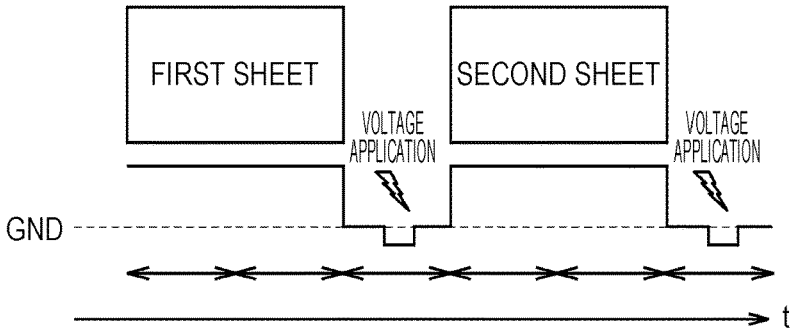
FIGS. 10A to 10D are diagrams showing a relationship between the bias voltage application and an interval between formed images according to the fourth embodiment.
Figure 10B:
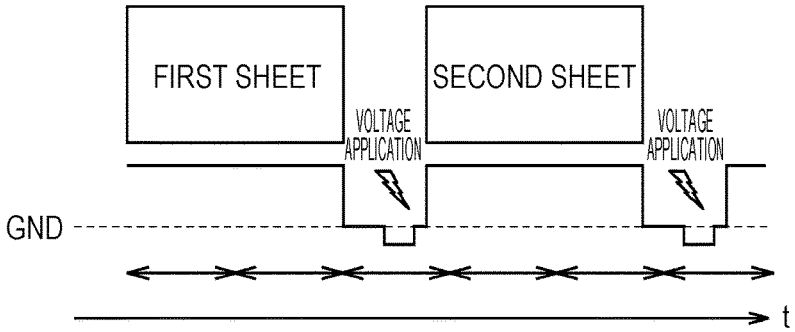

Here, it is preferable that an interval (an interval A in FIG. 9) between the front end of a transfer image and the front end of a subsequent transfer image is not an integral multiple of a period during which the secondary transfer roller 33 makes one rotation. For example, FIG. 10A shows a case where the interval between the front end of the transfer image and the front end of the subsequent transfer image is an integral multiple of the period during which the secondary transfer roller 33 makes one rotation (three times as an example). FIG. 10B shows a case where the interval between the front end of the transfer image and the front end of the subsequent transfer image is not an integral multiple of the period during which the secondary transfer roller 33 makes one rotation (2.8 times as an example).

Figure 10C:
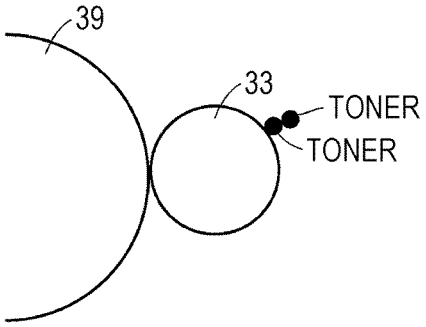

In the example shown in FIG. 10A, a position of the transfer belt 30 passing through the contact region R at the time of voltage application is concentrated in the same portion in the circumferential direction for each transfer image. As a result, a portion is generated where no voltage is applied in the circumferential direction of the transfer belt 30, and as shown in FIG. 10C, the toner is not discharged but accumulated at a specific portion on the transfer belt 30.

Figure 10D:
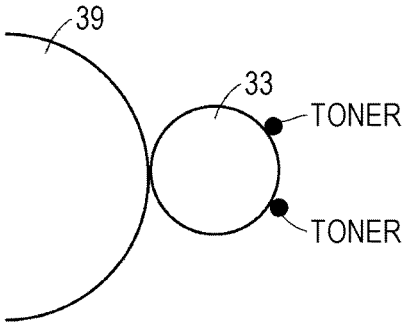

Therefore, as shown in FIGS. 10B and 10D, the interval between the front end of the transfer image and the front end of the subsequent transfer image is not set to an integral multiple of the period in which the secondary transfer roller 33 makes one rotation, whereby the voltage is applied to a different position in the circumferential direction of the secondary transfer roller 33 for each formed image. Thus, the toner adhering to the secondary transfer roller 33 can be moved onto the transfer belt 30 uniformly in the circumferential direction of the secondary transfer roller 33.

Further, it is preferable that an interval (the interval B in FIG. 9) between the rear end of the transfer image and the front end of the subsequent transfer image is longer than the period during which the transfer roller makes one rotation, and the bias voltage control device 421 continues to apply the voltage having the same polarity as the charge polarity of the toner in the interval. In this way, it is possible to apply the voltage having the same polarity as the charge polarity of the toner to the secondary transfer roller 33 during a period longer than the period during which the secondary transfer roller 33 makes one rotation, and the toner on the secondary transfer roller 33 can be reliably discharged to the transfer belt 30. As a result, an amount of toner adhering to the back side of the sheet to which the subsequent transfer image is transferred is reduced, so that it is possible to prevent the back side of the sheet from becoming dirty.

Fifth Embodiment

[Overview]

A fifth embodiment is different from the first embodiment in that in a case where a patch image is formed at the end of an execution job, a bias voltage control device 521 applies, to the secondary transfer roller 33, a voltage having the polarity opposite to the charge polarity of the toner and a voltage having the same polarity as the charge polarity of the toner at least once each. Note that, the image forming apparatus according to the present embodiment is implemented by the same configuration as that of the image forming apparatus 100 according to the above-described embodiment. Therefore, the description of the configuration thereof will not be repeated.

[Details]

Figure 11:
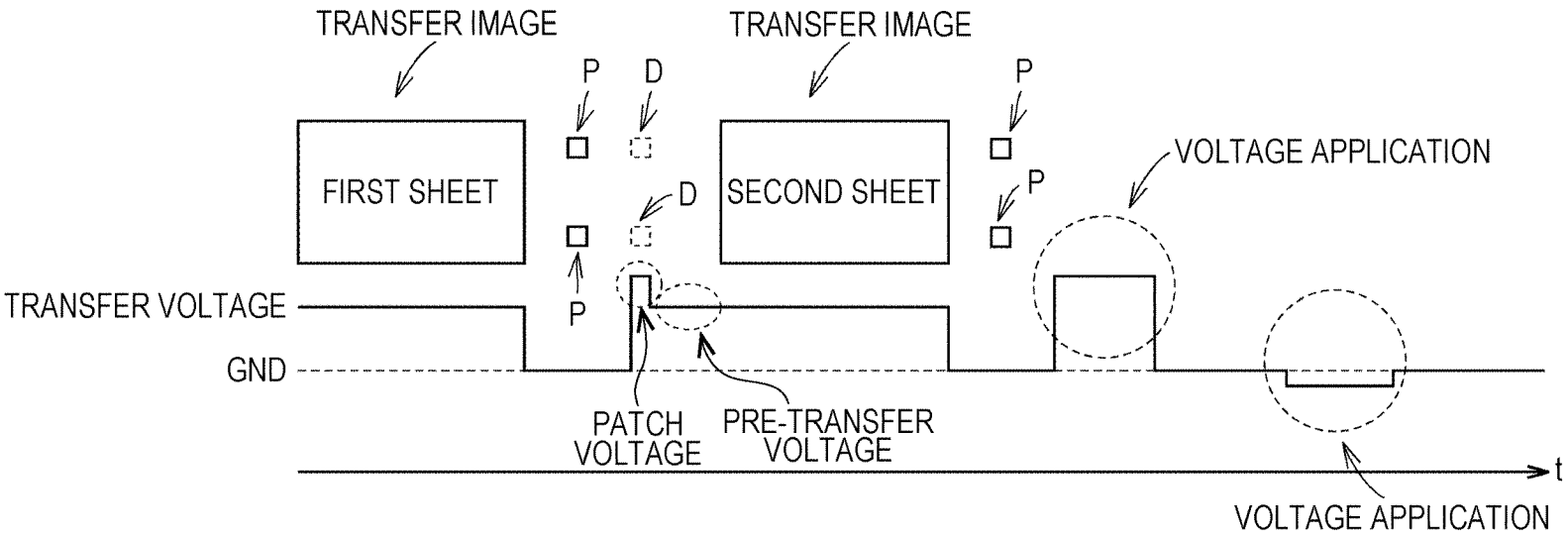
FIG. 11 is a timing chart of bias voltage application by a bias voltage control device according to a fifth embodiment.

With reference to FIG. 11, bias voltage control will be described in the bias voltage control device 521 according to the present embodiment. FIG. 11 is a timing chart of bias voltage application by the bias voltage control device 521 according to the fifth embodiment.

As shown in FIG. 11, in the case where the patch image is formed at the end of the execution job, the bias voltage control device 521 applies, to the secondary transfer roller 33, the voltage having the polarity opposite to the charge polarity of the toner and the voltage having the same polarity as the charge polarity of the toner at least once each. In this way, the next job can be started in a state where the toner on the secondary transfer roller 33 is removed.

Another Embodiment

The scope of application of the technical idea according to the present disclosure is not limited to the above embodiment. For example, while the patch image P passes through the contact region R, the bias voltage control device 121 may further apply a voltage (for example, −500 V to −1 kV) having the same polarity as the charge polarity of the toner to the transfer belt 30. In this way, the patch image P hardly adheres to the transfer belt 30, and passes through the contact region R while adhering to the transfer belt 30, so that toner adhesion amount can be reduced at the contact portion D on the secondary transfer roller 33. Even in this case, it is possible to obtain the same effect as the above embodiment.

Although embodiments of the present invention have been described and illustrated in detail, the disclosed embodiments are made for purposes of illustration and example only and not limitation. The scope of the present invention should be interpreted by terms of the appended claims, and it is intended that meanings equivalent to the claims and all modifications within the scope are included.

What is claimed is:

1. An image forming apparatus comprising:

an image carrier that rotates while carrying a toner image;

an image former that forms the toner image on the image carrier;

a transfer roller that is provided to face the image carrier and transfers the toner image to a recording medium conveyed to a contact region by being brought into contact with the image carrier while rotating; and a bias voltage applier that applies a voltage to the transfer roller, wherein the image former forms, on the image carrier with toner, a plurality of transfer images to be transferred onto the recording medium, and forms a patch image with toner between a first transfer image formed on the image carrier and a second transfer image formed thereafter, and the bias voltage applier applies a first voltage having a polarity opposite to a charge polarity of the toner to the transfer roller while each of the transfer images is transferred to the recording medium, applies a second voltage having the polarity opposite to the charge polarity of the toner and larger than the first voltage to the transfer roller while a contact portion on the transfer roller in contact with the patch image is in contact with the image carrier again by rotation of the transfer roller, and applies a third voltage having the polarity opposite to the charge polarity of the toner and smaller than the second voltage to the transfer roller, after application of the second voltage, until transfer of the second transfer image starts.

2. The image forming apparatus according to claim 1, wherein magnitude of the first voltage is equal to magnitude of the third voltage.

3. The image forming apparatus according to claim 1, wherein the bias voltage applier further applies the second voltage to the transfer roller, immediately after the patch image passes through the contact region, until the contact portion is brought into contact with the image carrier again.

4. The image forming apparatus according to claim 1, wherein the bias voltage applier further applies, to the transfer roller, a voltage having the polarity opposite to the charge polarity of the toner and larger than the first voltage, after formation of the second transfer image.

5. The image forming apparatus according to claim 1, wherein the bias voltage applier further applies, to the transfer roller, a voltage having a polarity identical to the charge polarity of the toner, after formation of the second transfer image.

6. The image forming apparatus according to claim 5, wherein a period of image formation for the plurality of transfer images is different from an integral multiple of a period during which the transfer roller makes one rotation.

7. The image forming apparatus according to claim 5, wherein an interval between the plurality of transfer images is longer than a period during which the transfer roller makes one rotation, and the bias voltage applier continues application of the voltage having the polarity identical to the charge polarity of the toner in the interval.

8. The image forming apparatus according to claim 1, wherein the bias voltage applier further applies a voltage having a polarity identical to the charge polarity of the toner to the transfer roller while the patch image passes through the contact region.

9. The image forming apparatus according to claim 1, wherein the patch image is further formed after formation of the plurality of transfer images, and the bias voltage applier applies, to the transfer roller, a voltage having the polarity opposite to the charge polarity of the toner and a voltage having a polarity identical to the charge polarity of the toner at least once each, after the patch image is formed after the formation of the plurality of transfer images.

* * * * *